United States Patent [19]

Gunnewig

[11] 4,278,200

[45] Jul. 14, 1981

[54] CONTINUOUSLY OPERATING CENTRIFUGAL SEPARATOR DRUM FOR THE CONCENTRATION OF SUSPENDED SOLIDS

[75] Inventor: Hubert Gunnewig, Oelde, Fed. Rep. of Germany

[73] Assignee: Westfalia Separator AG, Oelde, Fed. Rep. of Germany

[21] Appl. No.: 77,469

[22] Filed: Sep. 20, 1979

[30] Foreign Application Priority Data

Oct. 2, 1978 [DE] Fed. Rep. of Germany ..... 2842967

[51] Int. Cl.[3] ..... B04B 11/00

[52] U.S. Cl. ..... 233/16; 233/28

[58] Field of Search ..... 233/16, 19 R, 19 A, 233/21, 28, 29, 38, 39, 46

[56] References Cited

U.S. PATENT DOCUMENTS

| | | | |
|---|---|---|---|
| 2,526,292 | 10/1950 | Staaf | 233/16 X |
| 2,724,549 | 11/1955 | Brown | 233/21 X |

*Primary Examiner*—Christopher K. Moore

*Attorney, Agent, or Firm*—Sprung, Felfe, Horn, Lynch & Kramer

[57] ABSTRACT

A continuously operating centrifugal separator suitable for concentration of suspended solids contained in a liquid feed material, having a drum for separation of the feed material into a concentrated fraction and a clear fraction, a paring chamber 15 for discharge of the concentrated fraction, a first passageway 13 for delivery of the concentrated fraction from the periphery 12 of the drum to the paring chamber, and a second passageway for receiving concentrated fraction from the paring chamber and discharge thereof from the drum. The invention provides a conduit means for recycling some of the concentrated fraction which has been conveyed to the paring chamber to the first passageway. Thereby the concentration of solids in the concentrated fraction can be controlled without interferring with the separation being effected in the drum.

4 Claims, 1 Drawing Figure

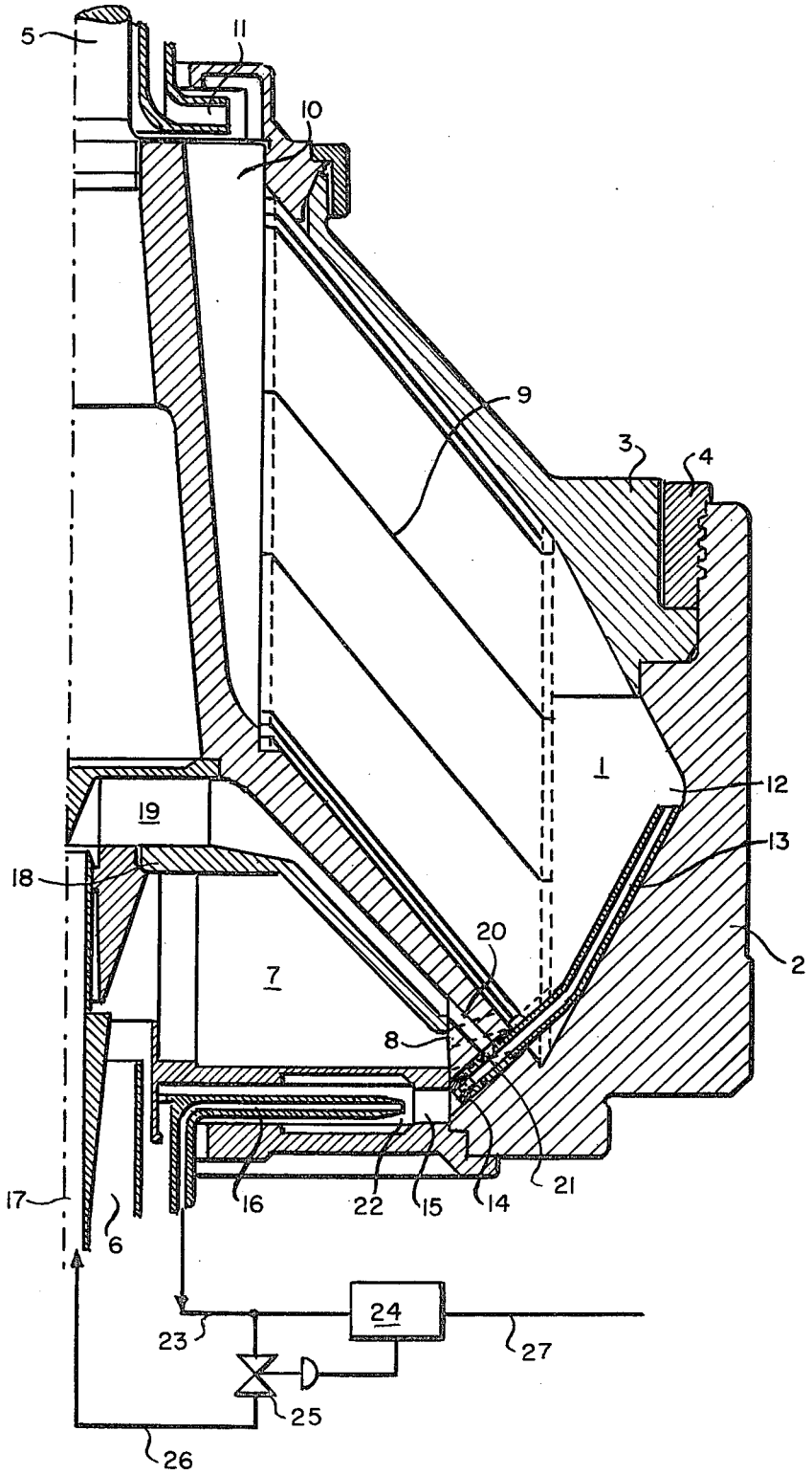
5
11
10
9
3
4
1
12
13
19
18
20
2
7
8
21
17
16
22
15
14
6
24
23
27
25
26

CONTINUOUSLY OPERATING CENTRIFUGAL SEPARATOR DRUM FOR THE CONCENTRATION OF SUSPENDED SOLIDS

BACKGROUND

The invention relates to a continuously operating centrifugal separator drum for the concentration of suspended solids, in which the separated solids are delivered from the periphery of the drum through tubes or passages provided with nozzle-like orifice pieces, into a paring chamber located on a smaller diameter, and the concentrate is removed under pressure by means of a paring member.

Such centrifugal separators are known, and they are used for the purpose of achieving constant concentrations of solids from a varying input of solids. This is brought about, for example, by the mechanical or hydraulic operation of valves in the drum or by the displacement of paring members.

German Offenlegungsschrift No. 2,701,624 discloses such a centrifugal separator for the concentration of suspensions, the nozzle-like orifice pieces consisting of resilient, deformable tubular membranes communicating with the paring disk chamber, and the outlet cross section of the tubular membranes being variable under the action of the liquid pressure prevailing in the paring chamber, it being possible in this manner to regulate the concentration of the solids being removed.

In the case of certain solids having an abrasive character, such tubular membranes, however, are not so suitable since they are subject to rapid wear.

Also, French Pat. No. 1,554,226 discloses a centrifugal separator in which the operation of the outlet valves is accomplished in relation to the concentration of the solids by means of a hydraulically, pneumatically or electromagnetically operating closing means which is disposed in the hollow spindle of the centrifuge and opens the outlet aperture of the outlet valves as the concentration increases and closes it as the concentration decreases.

In this system, fine regulation of the valve and hence of the concentrate is not possible, since the valves can only be fully opened or fully closed. Furthermore, on account of the high pressures, forces and rates of flow in the drum, trouble is often encountered in these complicated designs, and the familiar ruggedness of nozzle-type centrifugal separators is lost.

In order to achieve a high concentration of the solids even when the input of solids varies, a portion of the removed concentrate can be delivered back into the drum ahead of the nozzles.

In this method it is furthermore possible to make the nozzle outlet cross sections larger, thereby better preventing clogging of the nozzles.

Such a method and apparatus are known, for example, from German Offenlegungsschrift No. 1,432,763. It is disadvantageous in this method, however, that the solid that has collected in the outer drum chamber is stirred up by the continuous feed of concentrate thus adversely affecting the outflow of the clear phase.

THE INVENTION

The object of the present invention consists in constructing centrifugal separators of the type mentioned in the beginning such that the deficiencies named above are eliminated.

The object of the invention is achieved by providing passages and a distributor chamber for the return of a portion of the removed concentrate to the drum, and terminating these passages in the passages or tubes coming from the drum periphery, directly ahead of the nozzle-like orifice pieces.

The advantage of constructing the centrifugal drum in the manner of the invention is that, due to the return of a portion of the removed concentrate to a point directly ahead of the nozzle, the formerly disadvantageous stirring up of the concentrate that has collected in the solids chamber is prevented, and the separating capacity of the centrifugal separator can be substantially augmented in this manner. In conjunction with the paring member for the removal of concentrate, the return of the concentrate all the way to a point in front of the nozzles can be accomplished without the interposition of pumps or the like.

The concentrate return brings about a constant output of concentrate at high concentration, even though the feed of solids to the drum may vary, with the use of normal nozzles, e.g., cemented carbide nozzles which are subject to less wear and have no delicate parts. Also, the nozzle cross sections can be made still larger due to the improved concentrate discharge, as is the case in nozzles which are disposed on a smaller diameter of the drum. Therefore, the danger of the clogging of nozzles is still further reduced.

Thus, the invention is directed to a continuously operating centrifugal separator suitable for concentration of suspended solids contained in a liquid feed material, having a drum for separation of the feed material into a concentrated fraction and a clear fraction, a paring chamber for discharge of concentrated fraction, a first passageway for delivery of concentrated fraction from the periphery of the drum to the paring chamber, and a second passageway for receiving concentrated fraction from the paring chamber and discharge thereof from the drum. According to the invention conduit means are provided for recycling concentrated fraction which has been conveyed to the paring chamber to the first passageway for the control of the concentration of solids in the concentrated fraction without interference with the separation carried out in the drum.

An example of the embodiment of the invention is represented in the drawing.

The numeral 1 identifies the separating chamber of the centrifugal separator drum, which is defined at the bottom by the drum jacket 2 and on the top by the drum cover 3, and these are held together by the closing ring 4. The centrifugal separator drum is driven by a shaft 5 disposed centrally with respect to the drum. The feeding of the suspension to be concentrated is performed through the feed pipe 6 and a spreader chamber 7 through openings 8 in the drum jacket into the separating chamber 1 where the clear phase, after the separation in the separating insert 9, is removed under pressure through the guiding passages 10 and a paring member 11.

The concentrate deposited in the separating chamber 1 is delivered from the periphery 12 of the drum through passages or tubes 13 and nozzle-like orifice pieces 14 into a paring chamber 15 which is shielded from the spreading chamber 7, and it is carried from there under pressure by means of a paring member 16, a throttling member, which is not shown, being provided in the discharge line for regulating the depth of immersion of the paring member.

The return of a portion of the concentrate removed by the paring member is accomplished through a centrally disposed infeed line 17 leading to a spreading chamber 19 separated from the spreading chamber 7 by a partition 18, the concentrate being carried through passages 20 in the drum jacket 2 and 21 in the tube 13, directly ahead of the orifice pieces 14.

The concentration of the solids emerging from the nozzles is regulated by the amount of the concentrate returned.

The recycling can be performed as follows. The paring member 16 which extends into paring chamber 15, serves as part of a passageway for discharge of concentrated fraction from the drum. The discharged concentrated solids pass through line 23 to analyzer 24 which measures the concentration of solids in the concentrated fraction and is operatively connected to control valve 25 for controlling the amount of the concentrated fraction which is recycled. The recycle material passes via line 26 to passageway 17. The concentrated solids which are not recycled leave the process via line 27.

What is claimed is:

1. In a continuously operating centrifugal separator suitable for concentration of suspended solids contained in a liquid feed material, having a drum for separation of the feed material into a concentrated fraction and a clear fraction, a paring chamber for discharge of concentrated fraction, a first passageway for delivery of concentrated fraction from the periphery of the drum to said paring chamber, and a second passageway for receiving concentrated fraction from the paring chamber and discharge of concentrated fraction from the drum, the improvement which comprises conduit means for recycling concentrated fraction which has been conveyed to the paring chamber to the first passageway.

2. Centrifuge of claim 1, and a nozzle in the first passageway, the recycle means communicating with the first passageway upstream of the nozzle and adjacent thereto.

3. Centrifuge of claim 1 or 2, said paring chamber having a diameter smaller than the diameter of the drum.

4. Centrifuge according to claim 1, and means for measuring the concentration of solids in the concentrated fraction, and means for controlling the amount of the concentrated fraction which is recycled in dependence on the measurement of suspended solids in the concentrated fraction.

* * * * *